US008505222B2

(12) United States Patent
Koyess

(10) Patent No.: US 8,505,222 B2
(45) Date of Patent: Aug. 13, 2013

(54) HYBRID SKATE BOOT

(75) Inventor: Philippe Koyess, Montreal (CA)

(73) Assignee: Sport Maska Inc., Montreal, Quebec ( * ) Notice: Subject to any disclaimer, the term of this patent is extended or adjusted under 35 U.S.C. 154(b) by 746 days.

(21) Appl. No.: 12/522,240

(22) PCT Filed: Jan. 9, 2008

(86) PCT No.: PCT/CA2008/000031

§ 371 (c)(1),
(2), (4) Date: Jan. 4, 2010

(87) PCT Pub. No.: WO2008/083479

PCT Pub. Date: Jul. 17, 2008

(65) Prior Publication Data

US 2010/0139126 A1 Jun. 10, 2010

Related U.S. Application Data

(60) Provisional application No. 60/884,092, filed on Jan. 9, 2007.

(51) Int. Cl.
*A43B 5/16* (2006.01)
*A43B 7/20* (2006.01)

(52) U.S. Cl.
USPC ..... 36/115; 36/89; 36/72 R

(58) Field of Classification Search
USPC ..... 36/115, 89, 72 R, 45, 88, 117.1, 36/69
See application file for complete search history.

(56) References Cited

U.S. PATENT DOCUMENTS

| | | | | |
|---|---|---|---|---|
| 1,986,580 | A * | 1/1935 | Johnson | 36/89 |
| 3,659,361 | A * | 5/1972 | White, Sr. | 36/89 |
| 4,385,456 | A | 5/1983 | Livernois et al. | |
| 4,509,276 | A | 4/1985 | Bourque | |
| 5,234,230 | A * | 8/1993 | Crane et al. | 280/811 |
| 5,352,105 | A | 10/1994 | Yang | |
| 5,498,033 | A * | 3/1996 | Hoshizaki et al. | 280/841 |
| 6,000,148 | A * | 12/1999 | Cretinon | 36/88 |
| 6,079,128 | A | 6/2000 | Hoshizaki et al. | |
| 6,499,233 | B1 | 12/2002 | Chenevert | |
| 6,550,159 | B1 | 4/2003 | Madore | |
| 6,739,077 | B2 | 5/2004 | Morgan | |
| 6,749,203 | B2 | 6/2004 | Meibock et al. | |

(Continued)

FOREIGN PATENT DOCUMENTS

| | | |
|---|---|---|
| CA | 1148738 | 6/1993 |
| CA | 2112728 | 8/1994 |

(Continued)

*Primary Examiner* — John Kavanaugh
(74) *Attorney, Agent, or Firm* — Norton Rose Fulbright Canada LLP

(57) ABSTRACT

A skate includes a boot for receiving a wearer's foot and ankle therein, boot having a boot upper fixed to an outsole. The boot upper includes a vamp for covering a front portion of the foot, first and second quarters connected to the vamp for covering sides of the foot, an instep portion connected to the vamp and quarters for at least partly covering a top portion of the foot, and a rear portion connected to the quarters for covering a rear portion of the foot and ankle. At least the instep portion and part of the rear portion are made of a first material, and the first and second quarters are made of a different, second material. The second material is more rigid than the first material.

19 Claims, 2 Drawing Sheets

(56) References Cited

U.S. PATENT DOCUMENTS

| | | | | |
|---|---|---|---|---|
| 6,769,203 | B1 * | 8/2004 | Wright et al. | 36/115 |
| 6,871,424 | B2 | 3/2005 | Labonte et al. | |
| 7,039,977 | B2 | 5/2006 | Wilder | |
| 7,316,083 | B2 * | 1/2008 | Labonte | 36/115 |
| 2005/0116379 | A1 | 6/2005 | Goldsmith et al. | |
| 2005/0126046 | A1 | 6/2005 | Labonte et al. | |
| 2005/0210709 | A1 | 9/2005 | Labonte | |
| 2006/0179686 | A1 | 8/2006 | Labonte | |
| 2006/0179687 | A1 | 8/2006 | Labonte | |
| 2006/0181076 | A1 | 8/2006 | Labonte | |
| 2010/0192412 | A1 * | 8/2010 | Stewart | 36/89 |

FOREIGN PATENT DOCUMENTS

| | | |
|---|---|---|
| CA | 2238844 | 11/1998 |
| CA | 2241673 | 12/1998 |
| CA | 2084829 | 4/1999 |
| CA | 2256919 | 6/2000 |
| CA | 2309565 | 11/2001 |
| CA | 2328569 | 3/2006 |
| CA | 2515254 | 11/2006 |

* cited by examiner

HYBRID SKATE BOOT

CROSS-REFERENCE TO RELATED APPLICATIONS

The present application claims priority on U.S. Provisional Patent Application No. 60/884,092 filed Jan. 9, 2007, the entire contents of which is incorporated herein by reference.

FIELD OF THE INVENTION

The present invention relates to skates, such as ice skates or in-line roller skate for example, and more particularly to the boots of such skates.

BACKGROUND ART

Skate boots, and in particular ice hockey skate boots, have generally become more and more rigid through time in order to provide the necessary support for the players. Skate boots must usually provide at least some ankle support, while nevertheless allowing a certain degree of flexion to accommodate the dorsiflexion and plantar flexion of the ankle joint.

As such, a number of skate boot configurations have been designed in an attempt to provide both sufficient flexibility and support for the ankle. Such attempted configurations have included rigid skate boots having more flexible foam quarter panels, rigid boots with a flexible member surrounding the ankle, boots with a rigid tendon guard and more flexible quarters, etc. However, most of these designs either do not provide the desired flexibility or support, or are relatively complex, thus expensive, to produce.

Accordingly, improvements are desirable.

SUMMARY OF INVENTION

It is therefore an aim of the present invention to provide an improved skate boot. Therefore, in accordance with an aspect of the present invention, there is provided a skate comprising a boot for receiving a wearer's foot and ankle therein, the boot having a boot upper fixed to an outsole, the boot upper including: a vamp for covering a front portion of the foot; first and second quarters connected to the vamp for respectively covering at least first and second sides of the foot; an instep portion connected to the vamp and quarters for at least partly covering a top portion of the foot; a rear portion connected to the quarters for covering a rear portion of the foot and ankle; at least the instep portion and part of the rear portion being made of a first material; and the first and second quarters being made of a second material more rigid than the first material.

There is also provided, in accordance with another aspect of the present invention, a skate boot comprising: an outsole; a toe cap disposed at a forward end of the outsole; and an upper extending from the outsole and connected to the toe cap to surround a foot received in the skate boot, the upper including a quarter on each side of the skate boot, each said quarter being made of a first material that is more rigid than a second material of which a remainder of the upper is composed.

There is further provided, in accordance with another aspect of the present invention, a method of making a skate boot upper, comprising: integrally molding a boot portion from a first material, the boot portion including at least an instep portion and a tendon guard; manufacturing two quarters of a second material more rigid than the first material; and assembling the boot portion and the two quarters.

BRIEF DESCRIPTION OF THE DRAWINGS

Reference will now be made to the accompanying drawing, showing by way of illustration a particular embodiment of the present invention and in which.

DETAILED DESCRIPTION OF PARTICULAR EMBODIMENTS

Figure 1:
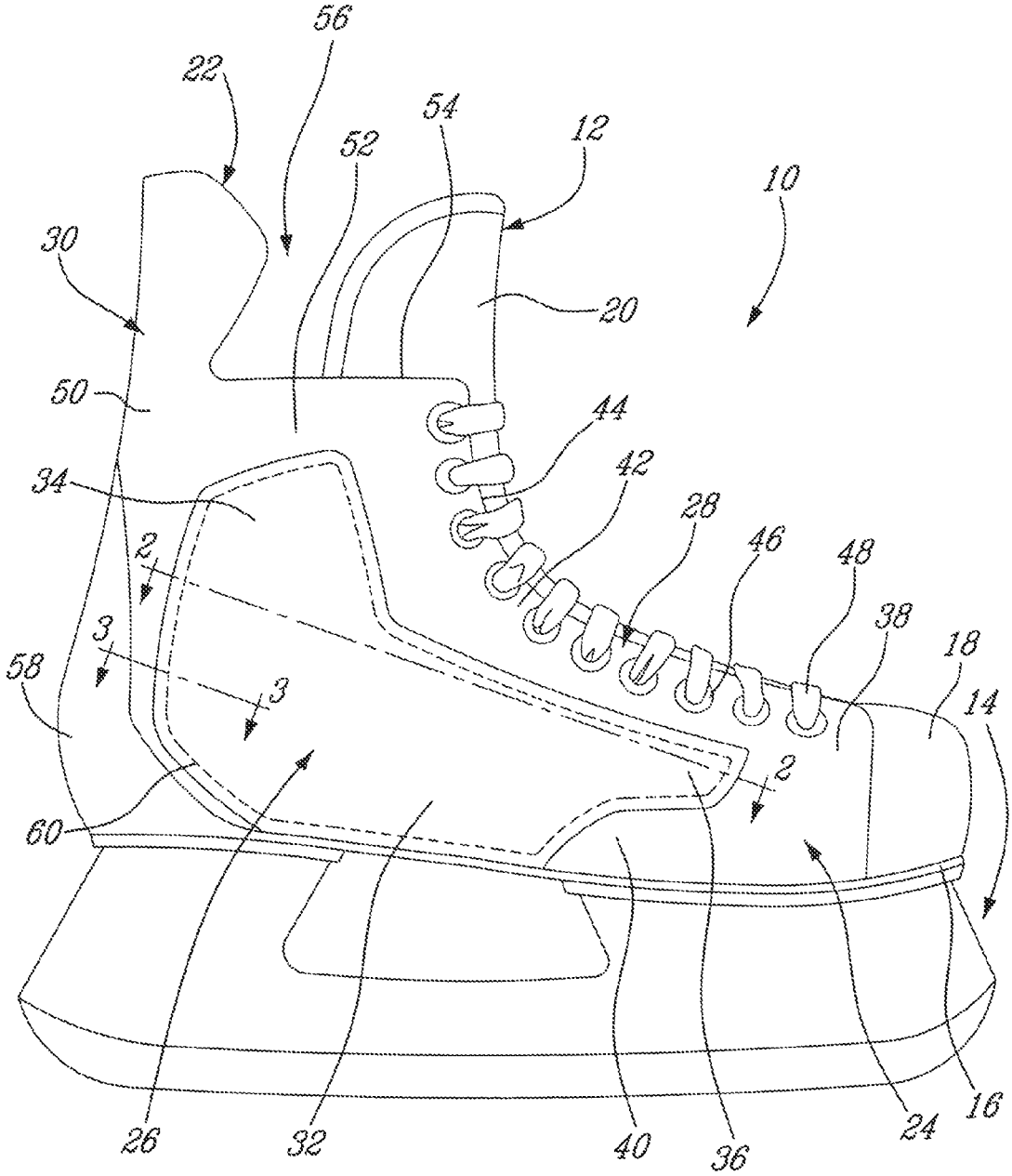
FIG. 1 is a side view of a skate in accordance with a particular embodiment of the present invention.

Referring now to FIG. 1, a skate according to a particular embodiment of the present invention is generally shown at 10. The skate 10 includes a boot 12, to which is attached a blade assembly 14. Although the skate 10 is depicted as an ice skate, it is to be understood that the present invention as described herein can equally apply to other types of skates, such as for example an in-line roller skate.

The boot 12 of the skate 10 generally includes an outsole 16 to which is connected the blade assembly 14, a toe cap 18 extending from the outsole 16 to surround and protect the toes, a tongue 20 extending from the toe cap 18 to cover the instep of the foot, and an upper 22 connected to the toe cap 18 and the outsole 16 to surround and protect the remainder of the foot and ankle.

The upper 22 of the boot 12 includes a vamp 24 connected to the toe cap 18, two quarters 26 (only one of which is shown in FIG. 1) each covering a respective side of the foot and ankle, an instep portion 28 at least partly covering the tongue 20, and a rear portion 30 extending from the outsole 16 to cover the rear of the foot and ankle.

Each quarter 26 extends upwardly from the outsole 16 and has an approximate "L" shape, defined by a bottom section 32 covering a side of the foot and a top section 34 extending from the bottom section 32 at the rear thereof to cover a side of the ankle. The bottom section 32 includes a forward finger portion 36 that extends forwardly therefrom, spaced apart from the outsole 16.

The vamp 24 includes inner and outer sections 38 (only one of which is shown) for respectively covering a front part of an inner and outer side of the foot. Each vamp section 38 extends upwardly from the outsole 16 and extends in a fore-aft direction between the bottom section 32 of the respective quarter 26 and the toe cap 18. As such, each vamp section 38 includes a rear finger portion 40 that extends rearwardly therefrom along the outsole 16, and which is complementary to the finger portion 36 of the respective quarter 26 which is disposed thereabove.

The instep portion 28 includes two sections 42 (only one of which is shown) extending upwardly from the respective quarter 26 and vamp section 38. Each section 42 of the instep portion 28 defines along the top thereof a tongue edge 44 extending over the tongue 20. Each section 42 of the instep portion 28 also includes a series of eyelets 46 defined therethrough and which are adjacent the tongue edge 44 and disposed along a substantial part of the length thereof. The two sections 42 of the instep portion 28 are interconnected by a lace 48 extending through the eyelets 46, which when tightened draws the two sections 42 of the opposed instep portions 28 together, such as to fasten the skate boot 12 in place on the foot of the wearer.

The rear portion 30 of the boot 12 extends upwardly from the outsole 16 at the rear thereof. The rear portion 30 includes a tendon guard 50 covering the rear of the foot and ankle and interconnecting the two quarters 26 around the rear of the boot. The rear portion 30 also includes two lateral sections 52 (only one of which is shown) extending frontwardly from the tendon guard 50 on a respective side of the foot up to the respective section 42 of the instep portion 28, and from the respective quarter 26 to the top line 54 around the opening 56 of the skate boot 12.

The skate boot 12 also includes an optional heel support 58 which extends from, and in at least one embodiment is integrally formed with, the outsole 16 at the rear thereof to cover a bottom portion of the tendon guard 50 for improved support to the heel.

Referring now to the quarters 26 of the boot 12 in more detail, the quarters 26 are preferably made of a material that is more rigid than at least that of the tendon guard 50 and the instep portion 28, and preferably also more rigid that that of the entire remainder of the upper 22 (i.e. the vamp 24, instep portion 28 and rear portion 30). The quarters 26 of the boot are thus made of a different material than a majority of the remainder of the boot. The relatively more rigid quarters 26 on either side of the skate boot therefore provide protection to the sides of the wearer's foot, as well as provide structure to the boot, the remainder of which is made of a softer and/or more flexible material which allows for improved movement of the ankle and foot. As such, both good support and protection is provided to the side of the ankle and foot, while allowing for a comfortable and flexible boot 12 facilitating the flexing motion of the ankle.

In a particular embodiment, the vamp 24, instep portion 28 and rear portion 30 are all integrally molded in a single piece, and the quarters 26 are attached thereto by a suitable fastening means. In one embodiment, the quarters 26 are attached to this single piece by stitching, as schematically illustrated by the stitch lines 60 in FIG. 1. Alternate methods to attach the quarters 26 to the remainder of the upper 22 are however also possible, and include adhesive and lamination for example. In the present embodiment, the upper 22 is thus formed of only three separate elements (i.e. the two quarters 26 and the single piece including the vamp 24, instep portion 28 and rear portion 30) which are easily assembled together, providing a relatively simple manufacturing process.

Figure 2:
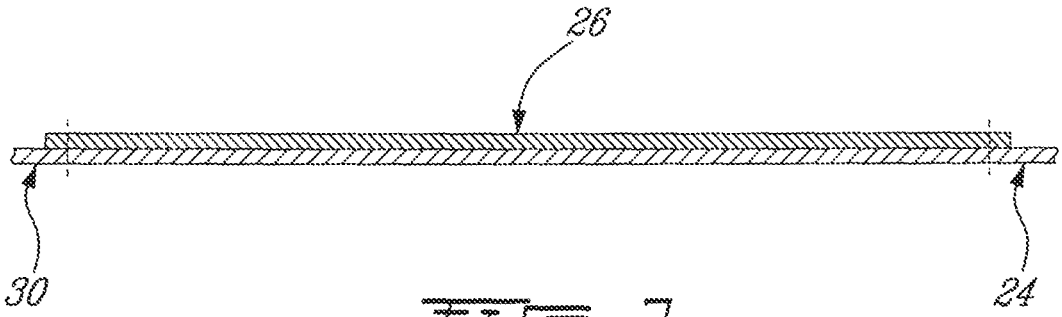
FIG. 2 is a cross-section of part of the skate of FIG. 1 taken along line 2-2, in accordance with a particular embodiment.
Figure 3:
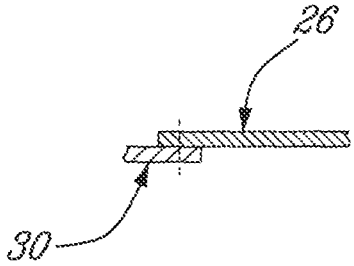
FIG. 3 is a cross-section of part of the skate of FIG. 1 taken along line 3-3, in accordance with another particular embodiment.

In a particular embodiment, the quarters 26 overlap the remainder of the upper 22 only along edges thereof sufficient to allow the connection therebetween, as shown in FIG. 3. In an alternate embodiment, however, the quarters 26 completely overlap the remainder of the upper 22, i.e. the upper 22 includes a layer of flexible material beneath the overlaid quarters 26, to which the quarters 26 are connected as shown in FIG. 2.

The vamp 24, instep portion 28 and rear portion 30 are preferably made of a material having sufficient flexibility for a comfortable fit, an adequate abrasion resistant surface finish, and which can be easily formed to the desired shape. In one particular embodiment, the vamp 24, instep portion 28 and rear portion 30 are all made of ethylene vinyl acetate (EVA), optionally covered (e.g. laminated) with a layer of polyurethane to provide an improved surface finish.

The quarters 26 are preferably made of a material having sufficient rigidity for providing proper support, an adequate abrasion resistant surface finish, and which can be easily formed to the desired shape. In one particular embodiment, the quarters 26 include a plurality of laminated layers, which include layers of at least one of expanded polypropylene (EPP) and poly(ethylene-co-methacrylic acid) (EMAA), also known as Surlyn®. The layers also optionally include one or more layers of mesh or filament, preferably made of a plastic such as nylon, for improved rigidity.

In an alternate embodiment, the quarters 26 can be made of a single layer of an adequate material, such as for example EPP or Surlyn®.

In a particular embodiment, the heel support 58 is integrally formed (such as by molding for example) with the outsole 16 to form a single integral piece, and the heel support 58 and outsole 16 are made of a rigid composite material, such as for example a material including carbon fiber. Such a construction provides improved support for the heel, particularly in tight turns, and provides for an improved energy transmission to the ice while skating.

In another embodiment, the toe cap 18 may also be integrally formed with the outsole 16, in the same manner as the heel support 58, such as to form a single integral piece composed of the same material (such as a carbon fiber based material as noted above). Further, both the heel support 58 and the top cap 18 can be both integrally formed with the outsole 16, such as to form a single integral piece to which the rest of the boot 12 is attached.

The embodiments of the invention described above are intended to be exemplary. Those skilled in the art will therefore appreciate that the foregoing description is illustrative only, and that various alternate configurations and modifications can be devised without departing from the spirit of the present invention. For example, the boot configuration of the present invention could be applied to types of boots other than skate boots. Accordingly, the present invention is intended to embrace all such alternate configurations, modifications and variances which fall within the scope of the appended claims.

The invention claimed is:

1. A skate boot for receiving a wearer's foot and ankle therein, the boot comprising:

a boot upper fixed to an outsole, the boot upper consisting of a first quarter, a second quarter and a remainder of the upper;

each quarter having a bottom section for covering a side of the foot and a top section for covering a side of the ankle, the bottom section extending forwardly from the top section and the top section extending upwardly from the bottom section;

the remainder of the upper including:

a vamp for covering a front portion of the foot and connected to the quarters, an instep portion connected to the vamp and quarters for at least partly covering a top portion of the foot, and a rear portion connected to the quarters for covering a rear portion of the foot and ankle;

wherein at least the instep portion is made of a first material;

wherein the first and second quarters are made of a second material more rigid than the first material, with at least a major part of the instep portion being free of the second material, and wherein the first and second quarters are connected to the remainder of the upper through stitching, adhesive or lamination.

2. The skate boot according to claim 1, wherein at least an upper part of the rear portion is made of the first material.

3. The skate boot according to claim 2, wherein at least the instep portion and the upper part of the rear portion are integrally molded in a single piece.

4. The skate boot according to claim 1, wherein each quarter overlaps the remainder of the upper only along edges of the quarter and is connected to the remainder of the upper along said edges.

5. The skate boot according to claim 1, wherein the first material has a rigidity at least equal to that of ethylene vinyl acetate (EVA).

6. The skate boot according to claim 1, wherein the first material includes ethylene vinyl acetate (EVA) and the second material includes at least one of expanded polypropylene (EPP) and poly(ethylene-co-methacrylic acid) (EMAA).

7. The skate boot according to claim 6, wherein the second material also includes filaments.

8. The skate boot according to claim 1, wherein the second material is a multilayer material.

9. A skate boot comprising:

an outsole;

a toe cap disposed at a forward end of the outsole; and an upper extending from the outsole and connected to the toe cap to surround a foot and ankle received in the skate boot, the upper including a first portion including two opposed elements each having an approximate "L" shape covering sides of the foot and of the ankle, and a second portion extending at least upwardly from an edge of the elements of the first portion, the first and second portion including different materials, the second portion being more flexible than the first portion, the first and second portions being interconnected through stitching, adhesive or lamination.

10. The skate boot according to claim 9, wherein the second portion is integrally molded in a single piece.

11. The skate boot according to claim 9, further comprising a heel support extending from the outsole and integrally formed therewith in a single piece to cover a rear portion of the upper.

12. The skate boot according to claim 11, wherein the outsole is made of a material including carbon fiber.

13. The skate boot according to claim 9, wherein the toe cap is integrally formed with the outsole in a single piece.

14. The skate boot according to claim 9, wherein the first portion includes at least one of expanded polypropylene (EPP) and poly(ethylene-co-methacrylic acid) (EMAA) and the second portion includes ethylene vinyl acetate (EVA).

15. The skate boot according to claim 14, wherein the first portion also includes a filament layer or a mesh layer.

16. The skate boot according to claim 9, wherein second portion has a rigidity at least equal that of ethylene vinyl acetate (EVA).

17. The skate according to claim 1, wherein each quarter is made of a single piece.

18. The skate according to claim 1, wherein the top and bottom sections together have an approximate "L" shape.

19. The skate according to claim 1, wherein the first and second quarters are more rigid than the vamp and the rear portion.

* * * * *